US007044812B2

(12) United States Patent
Fry, Jr. et al.

(10) Patent No.: US 7,044,812 B2
(45) Date of Patent: May 16, 2006

(54) SURFACE MOUNT HEADER ASSEMBLY HAVING A PLANAR ALIGNMENT SURFACE

(75) Inventors: Daniel Williams Fry, Jr., Elizabethtown, PA (US); John Mark Myer, Millersville, PA (US); Hurley Chester Moll, Harrisburg, PA (US); Alexandra Lynne Matthews Spitler, Palmyra, PA (US); Randy Thomas Matthews, Yadkinville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/718,371

(22) Filed: Nov. 20, 2003

(65) Prior Publication Data

US 2005/0112916 A1 May 26, 2005

(51) Int. Cl.
*H01R 4/02* (2006.01)

(52) U.S. Cl. ..... 439/876

(58) Field of Classification Search ..... 439/78, 439/79, 108, 60, 83, 876
See application file for complete search history.

(56) References Cited

U.S. PATENT DOCUMENTS 4,762,500 A * 8/1988 Dola et al. ..... 439/79
4,960,391 A * 10/1990 Beinhaur et al. ..... 439/559
5,281,160 A * 1/1994 Walkup et al. ..... 439/266
5,336,116 A * 8/1994 Boteler ..... 439/690
5,451,158 A * 9/1995 Lin et al. ..... 439/79
5,487,674 A 1/1996 Guzik et al.
5,667,393 A * 9/1997 Grabbe et al. ..... 600/443
5,697,799 A * 12/1997 Consoli et al. ..... 439/181
5,772,474 A * 6/1998 Yagi et al. ..... 439/660
6,135,781 A * 10/2000 Pope et al. ..... 439/59
6,338,630 B1 * 1/2002 Dong ..... 439/74
6,361,332 B1 3/2002 Froude et al.
6,419,526 B1 * 7/2002 Fair et al. ..... 439/676
6,827,588 B1 * 12/2004 Huang et al. ..... 439/74
2005/0009379 A1 * 1/2005 Huang et al. ..... 439/65

FOREIGN PATENT DOCUMENTS

WO WO 98/02942 1/1998

* cited by examiner

*Primary Examiner*—Chandrika Prasad

(57) ABSTRACT

A header assembly includes an insulative housing comprising a plurality of walls defining an interior cavity, and a plurality of contacts within said cavity and extending through one of the walls to an exterior of the housing for surface mounting to a circuit board. The insulating housing comprises at least one alignment rib extending on an exterior surface thereof. The contacts are formed to abut the alignment rib, thereby ensuring coplanarity of the contacts for surface mounting to a circuit board.

21 Claims, 7 Drawing Sheets

SURFACE MOUNT HEADER ASSEMBLY HAVING A PLANAR ALIGNMENT SURFACE

BACKGROUND OF THE INVENTION

This invention relates generally to electrical connectors, and, more specifically, to surface mount header assemblies for mating engagement with plug assemblies.

The mating of a plug assembly into a receptacle assembly to form a connector assembly often involves a high insertion force. This is particularly true when the connector comprises mating connector housings containing many contacts. For example, automobile wiring systems, such as power train systems, typically include electrical connectors. Typically, each electrical connector includes a plug assembly and a header assembly. The plug assembly is mated into a shroud of the header assembly. The header assembly is in turn mounted on a printed circuit board. Each of the plug assembly and the header assembly typically includes a large number of electrical contacts, and the contacts in the header assembly are electrically and mechanically connected to respective contacts in the plug assembly when the header assembly and the plug assembly are engaged. To overcome the high insertion force to connect the plug assembly into the header assembly, an actuating lever is sometimes employed to mate contacts of the plug assembly and the header assembly.

Surface mount header assemblies provide a number of advantages over through-hole mounted header assemblies. In addition to offering cost and process advantages, surface mounting allows for a reduced footprint for the header assembly and thus saves valuable space on a circuit board or permits a reduction in size of the circuit board. When the header assembly is surface mounted to a circuit board, solder tails extend from one side of the header assembly in an angled manner for surface mounting to a circuit board, and also extend substantially perpendicular from another side of the header assembly for mating engagement with contacts of the plug assembly. In one automotive connector system, fifty two contacts are employed in one version of the header assembly, and the large number of contacts presents manufacturing and assembly challenges in fabricating the header assembly, as well as installation problems during surface mounting of the header assembly to the circuit board.

For example, it is desirable for surface mounting that the solder tails of the header assembly are coplanar to one another for mounting to the plane of a circuit board. Achieving coplanarity with a large number of contact pins, however, is difficult due to manufacturing tolerances over a large number of contacts. Sometimes additional solder paste is utilized to compensate for tolerances of the contacts or for misalignment of the pin contacts during assembly of the header. Over a large number of header assemblies, however, the incremental cost of the increased amount of solder paste per header assembly can be significant, and non-planarity of the pin contacts with respect to the plane of the circuit board may negatively affect the reliability of the header assembly. Additional solder paste thickness can also cause solder bridging problems for other surface mount components on fine pitch or may require different stencils to be used. Depending upon the degree of non-planarity of the solder tails, some of the contacts may be weakly connected or not connected to the circuit board at all, either of which is an undesirable and unacceptable result.

Furthermore, the high insertion forces during engagement and disengagement of the header assembly and the plug assembly may be detrimental to the soldered connections of the header assembly. To prevent the soldered connections from being broken, a solder clip is sometimes used which is soldered to the circuit board at the corners of the header. As such, the mechanical connection of the solder clips incur the brunt of mechanical strain as the header assembly is mated and unmated from a mating connector. Tolerances in manufacturing the solder clips, however, introduce additional non-planarity issues when the header assembly is soldered to a circuit board. At one end of the tolerance range, the solder clips may prevent the contacts from fully contacting the circuit board, which may impair the quality of the soldered connections of the contacts. At the other end of the tolerance range, the solder clips may not fully contact the circuit board during soldering, which may impair the ability of the solder clips to spare the contacts from large insertion and extraction forces as the header assembly is engaged and disengaged from a mating connector.

BRIEF DESCRIPTION OF THE INVENTION

In accordance with an exemplary embodiment, a header assembly comprises an insulative housing comprising a plurality of walls defining an interior cavity, and a plurality of contacts within said cavity and extending through one of the walls to an exterior of the housing for surface mounting to a circuit board. The insulating housing comprises at least one alignment rib extending on an exterior surface thereof. The contacts are formed to abut the alignment rib, thereby ensuring coplanarity of the contacts for surface mounting to a circuit board.

Optionally, the housing comprises longitudinal side walls and lateral side walls, and alignment ribs extending parallel to each of the longitudinal side walls. The contacts may extend through a bottom wall in a plurality of rows, and the contacts in each of the plurality of rows abut the alignment rib, and the contacts are flexed and preloaded against the alignment rib. A solder clip is attached to one of the longitudinal and the lateral side walls, and the solder clip comprises an engagement surface coplanar with the contacts when the contacts are abutted against the alignment rib. The contacts include rounded ends and the alignment ribs include a crowned surface, and the rounded ends engaging the crowned surface as the contacts are preloaded.

According to another exemplary embodiment, a header assembly comprises an insulative housing comprising a plurality of walls defining an interior cavity and a contact interface, and at least one alignment rib extending proximate the contact interface. A plurality of contacts having contact sections and solder tail sections are provided. The contact sections are located within the interior cavity, and the solder tail sections extend exterior to the contact interface for surface mounting to a circuit board. The solder tails abut the alignment rib and are preloaded against the alignment rib as the contacts are installed into the housing, thereby ensuring coplanarity of the solder tail sections for surface mounting to the circuit board.

According to another exemplary embodiment, a method of assembling a surface mount header assembly is provided. The assembly includes an insulative housing including a plurality of walls defining an interior surface, an exterior surface, and a plurality of contact apertures extending therebetween. The housing further includes an alignment rib extending on the exterior surface, and a plurality of electrical contacts. The method comprises inserting the contacts through the contact apertures, and flexing a portion of the contacts against the alignment rib as the contacts are inserted, thereby preloading the contacts against the alignment rib in a coplanar relationship with one another.

According to still another embodiment, a header assembly is provided. The header assembly includes an insulative housing having a mating face and comprising an alignment rib extending along the mounting face and having a planar alignment edge. A plurality of contacts are positioned relative to said housing, such that a mounting portion of each of said contacts abuts the alignment edge thereby ensuring coplanarity of the contacts.

DETAILED DESCRIPTION OF THE INVENTION

Figure 1:
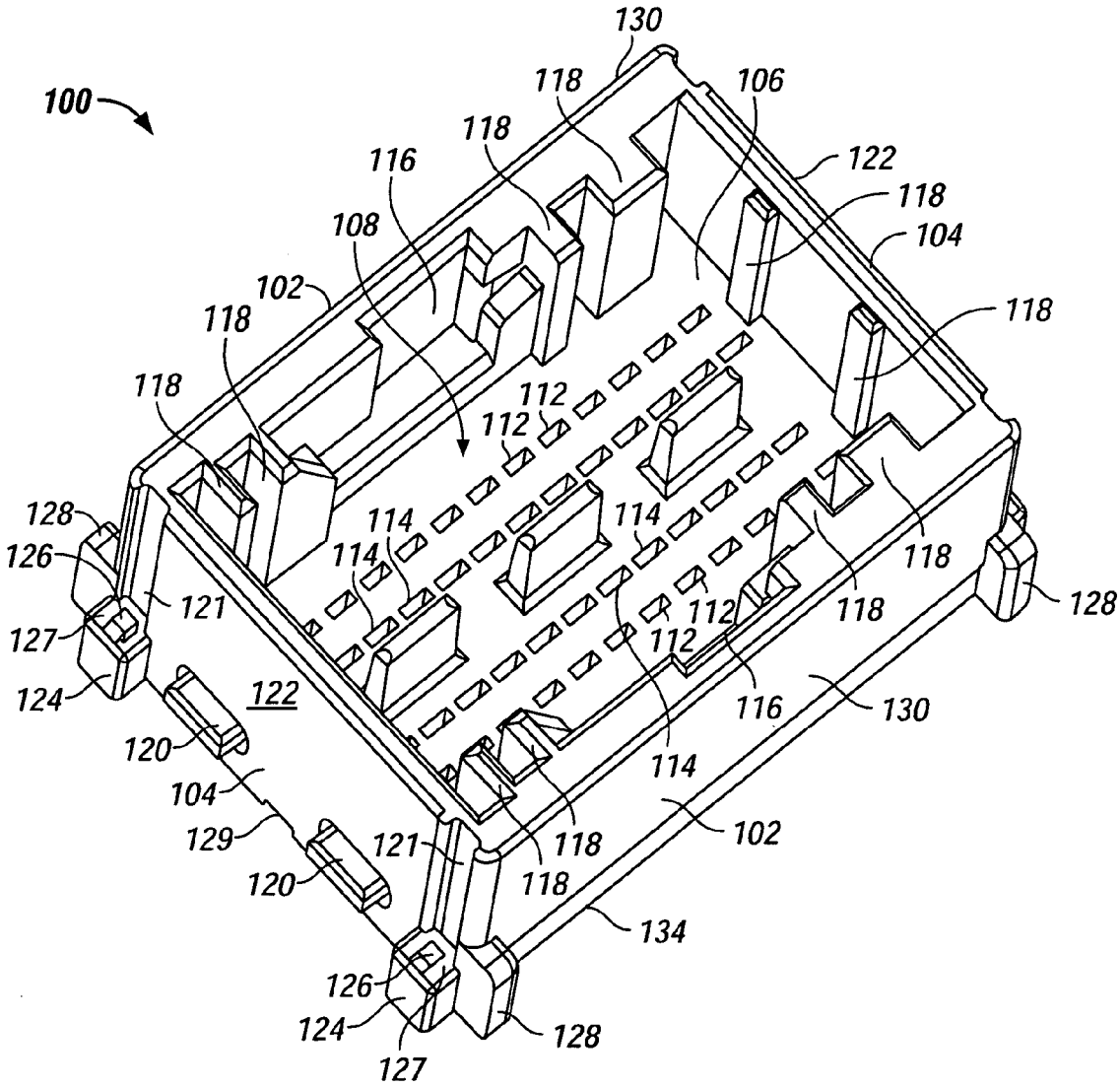
FIG. 1 is a top perspective view of a housing for a surface mount header assembly formed in accordance with an exemplary embodiment of the invention.
Figure 2:
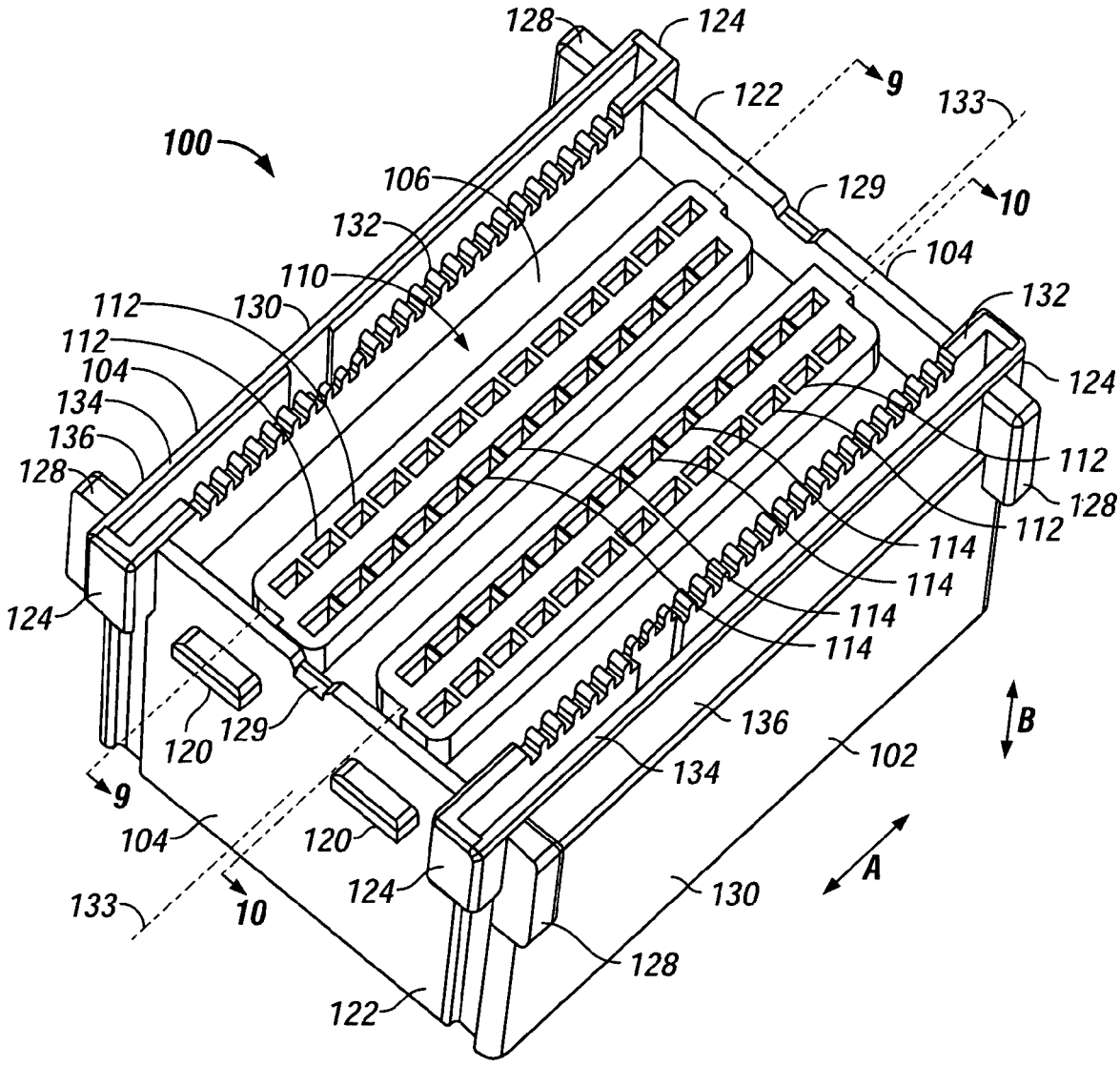
FIG. 2 is a bottom perspective view of the housing shown in FIG. 1.

FIGS. 1 and 2 are top and bottom perspective views, respectively, of a an exemplary housing 100, sometimes referred to as a shroud, for a surface mount header assembly formed in accordance with an exemplary embodiment of the invention.

The housing 100 includes a pair of longitudinal side walls 102, a pair of lateral side walls 104 extending between the ends of the longitudinal side walls 102, and a bottom wall 106 extending between the longitudinal and lateral side walls 102 and 104. The side walls 102 and 104 and the bottom wall 106 collectively define a contact cavity 108 in the top side of the housing 100 (FIG. 1), and a contact interface 110 on the bottom side of the housing 100 (FIG. 2). A first or outer row of contact apertures 112 and a second or inner row of contact apertures 114 are provided through the bottom wall 106 in a parallel relationship to each of the longitudinal side walls 102 of the housing 100, thereby providing four rows of apertures extending from the contact cavity 108 through the bottom wall 106 to the contact interface 110. In the illustrated embodiment, each of the rows of contact apertures 112 and 114 includes thirteen contact apertures, thereby providing a fifty two (13×4) position housing 100. It is recognized, however, that greater or fewer apertures may be provided in greater or fewer rows in various alternative embodiments without departing from the scope and spirit of the present invention.

Lever slots 116 are formed in each of the longitudinal side walls 102 in communication with the contact cavity 108 (FIG. 1). The lever slots 116 are configured for receiving and maintaining an actuation lever of a mating connector (not shown) for engaging electrical contacts of the mating connector with electrical contacts (described below) in the header. Various slots and keying features 118 are provided in the longitudinal side walls 102, the lateral side walls 104, and the bottom wall 106 of the housing 100 for guiding mating portions of the mating connector to align the electrical contacts of the header and the mating connector. It is understood, however, that in alternative embodiments the lever slots 116 and/or the slots and keying features 118 may be omitted in a manual (i.e., not assisted) connector assembly.

Solder clip mounting lugs 120 extend outwardly from exterior surfaces 122 of each of the lateral side walls 104 between the longitudinal side walls 102. Alignment lugs 124 are also extended outwardly from each of the exterior surfaces 122 of the lateral side walls 104 at the corners of the housing 100. Each of the alignment lugs 124 includes a biasing rib 126 (FIG. 1) on an end surface 127 thereof. As explained below, the mounting lugs 120, the alignment lugs 124 and the biasing ribs 126 serve to locate solder clips (described below) on each of the lateral side walls 104 of the housing 100 so that surfaces of the solder clips are positioned coplanar with solder tails on the contact interface 110 (FIG. 2) of the housing 100. Troughs or slots 121 may be provided around the alignment lugs 124 for collection of skived or shaved portions of the lugs 120 as the solder clips are installed. Notches 129 are provided in the bottom end of the lateral side walls 104, and the notches are employed to retain the solder clips to the lateral side walls 104 as explained below.

Optionally, and in an exemplary embodiment, lugs 128 extend outwardly from the longitudinal side walls 102 at the corners of the housing 100. The lugs 128 provide a keying feature for a mating connector on an exterior surface 130 of the longitudinal side walls 102. While the lugs 124 and 128 are illustrated as substantially rectangular in shape, it is recognized that other shapes of lugs 124 and 128 may be alternatively used in other embodiments of the invention.

Referring to FIG. 2, the contact interface 110 of the housing 100 includes a slotted positioning member 132 extending parallel to the longitudinal side walls 102, and one slot is provided in the positioning member 132 for each contact aperture in the outer row of apertures 112 and the inner row of apertures 114. When solder tails of the contacts (described below) are received in the respective slots of the positioning member 132, the solder tails are prevented from moving in the direction of arrow A which extends substantially parallel to a longitudinal axis 133 of the housing 100. The contact interface 110 further includes an alignment surface 134 extending upon an alignment rib 136 adjacent each of the longitudinal side walls 102. The alignment surfaces 134 are coplanar to one another and are laterally spaced from the positioning members 132 such that the positioning members 132 are located between the alignment surfaces and the respective outer row of contact apertures 112. As explained below, the alignment surfaces 134 provide a registration surface which ensures that ends of the solder tails on the contact interface 110 are coplanar to one another. Preloading of the solder tails against the alignment surfaces 134, as explained below, prevents the solder tails from moving in the direction of arrow B which extends perpendicular to the longitudinal axis 133.

In an exemplary embodiment, the positioning member 132, the alignment rib 136 and the alignment lugs 124 are integrally formed with one another. By forming the alignment rib 136 and the alignment lugs 124 in an integral fashion, the top surface 127 (FIG. 1) of the alignment lugs 124 are located a fixed distance from the alignment surfaces 134. As such, the solder clips may be precisely positioned with respect to the alignment surface as described below to achieve coplanarity of the solder clips with the alignment surfaces 134. Alternatively, the alignment rib 136, the positioning member 132, and the alignment lugs 124 may be separately fabricated and attached to the housing 100.

In an exemplary embodiment, the housing 100, including each of the aforementioned features, is integrally formed from an electrically insulative (i.e., nonconductive material), such as plastic, according to a known process, such as an injection molding process. It is recognized, however, that the housing 100 may alternatively be formed of separate pieces and from other materials as those in the art may appreciate.

Figure 3:
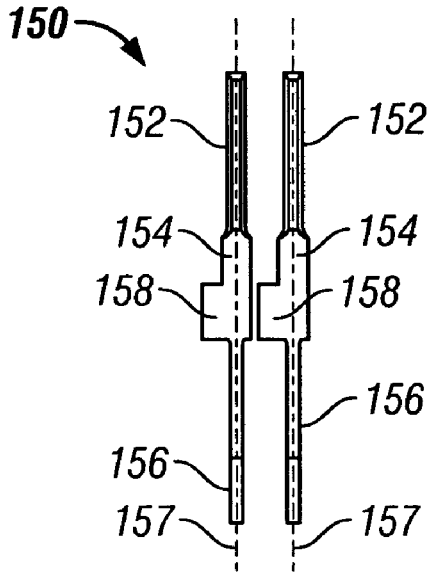
FIG. 3 is front elevational view of a first contact assembly used with the housing shown in FIGS. 1 and 2.

FIG. 3 is front elevational view of a first contact set 150 which may be employed in the outer row of contact apertures 112 (shown in FIGS. 1 and 2) of the housing 100. In an exemplary embodiment, the contact set 150 includes contact sections 152, aperture sections 154 and solder tail sections 156. The aperture sections 154 are dimensioned to produce an interference fit when inserted into an aperture in the row of contact apertures 112, and the contact sections 152 and the solder tail sections 156 are aligned with one another along a common centerline 157.

Transverse carrier strips 158 join the aperture sections 154, and when the carrier strips 158 are sheared during assembly of the header, the contact set 150 is separated into individual contacts. While only two contacts are shown in FIG. 3, it is understood that the contact set 150 includes a number of contacts corresponding to the number of contact apertures in the contact rows 112 (shown in FIGS. 1 and 2). The contact set 150 may be fabricated from a single piece of metal, such as copper or a copper alloy, and further may be coated or plated with tin, lead, gold, etc. as necessary to obtain desired electrical and mechanical characteristics and properties of the contact set 150.

Figure 4:
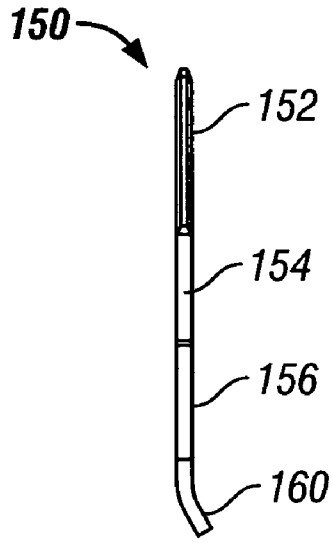
FIG. 4 is a side elevational view of the contacts shown in FIG. 3.

FIG. 4 is a side elevational view of the contact set 150 illustrating a small radius formed in an end 160 of the solder tail sections 156. The radius creates a rounded end 160 which, as will be seen below, mitigates tolerances or misalignment of the contact set 150 as the header is assembled. In an alternative embodiment, the radius may be omitted and the ends of the contact set 150 may be straight.

Figure 5:
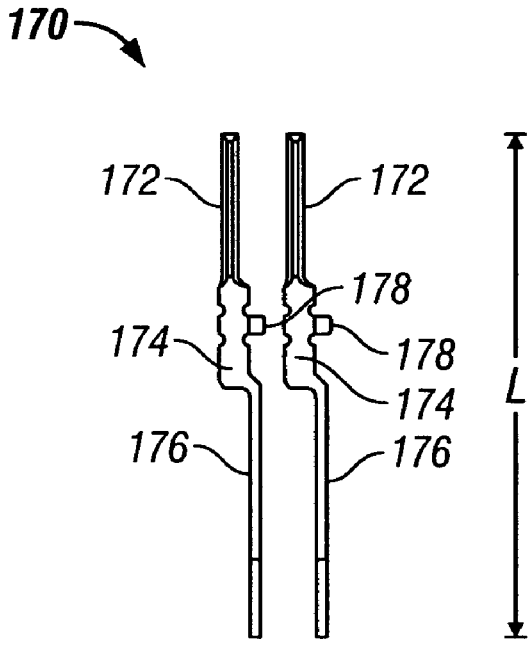
FIG. 5 is a front elevational view of a second contact assembly used with the housing shown in FIGS. 1 and 2.

FIG. 5 is a front elevational view of a second contact set 170 which may be employed in the inner row of contact apertures 114 (shown in FIGS. 1 and 2) of the housing 100. In an exemplary embodiment, the contact set 170 includes contact sections 172, aperture sections 174 and solder tail sections 176. The aperture sections 174 are shaped and dimensioned to produce an interference fit when inserted into an aperture in the row of contact apertures 114 and the contact sections 172 and the solder tail sections 176 are offset with respect to one another relative to the aperture sections 174. That is, the contact sections 172 and the solder tail sections 176 have spaced centerlines. The offset in contact sections 172 and solder tail sections 176 achieves a desired centerline spacing of the solder tail sections 176 relative to the solder tail sections 156 (shown in FIGS. 3 and 4) when the contact sets 150 and 170 are installed in the housing 100. Because the contact set 170 is installed to the inner row of contact apertures 114, the contact set 170 has a greater length L than the first contact set 150 which is installed to the outer row of contact apertures 112 in the housing 100.

Transverse carrier strips 178 join the aperture sections 174, and when the carrier strips 178 are sheared during assembly of the header, the contact set 170 is separated into individual contacts. While only two contacts are shown in FIG. 5, it is understood that the contact set 170 includes a corresponding number of contacts as there are contact apertures in the contact rows 114. The contact set 170 may be fabricated from a single piece of metal, such as copper or a copper alloy, and further may be coated or plated with tin, lead, gold, etc. as necessary to obtain desired electrical and mechanical characteristics and properties of the contact set 170.

Figure 6:
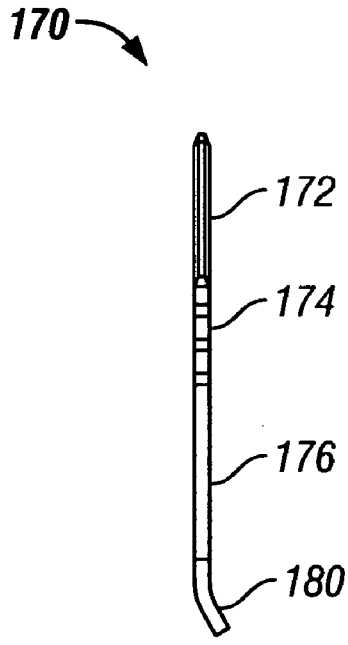
FIG. 6 is a side elevational view of the contacts shown in FIG. 5.

FIG. 6 is a side elevational view of the contact set 170 illustrating a small radius formed in an end 180 of the solder tail sections 176. The radius creates a rounded end 180 which, as will be seen below, mitigates tolerances or misalignment of the contact set 170 as the header is assembled. In an alternative embodiment, the radius may be omitted and the ends of the contact set 170 may be straight.

Figure 7:
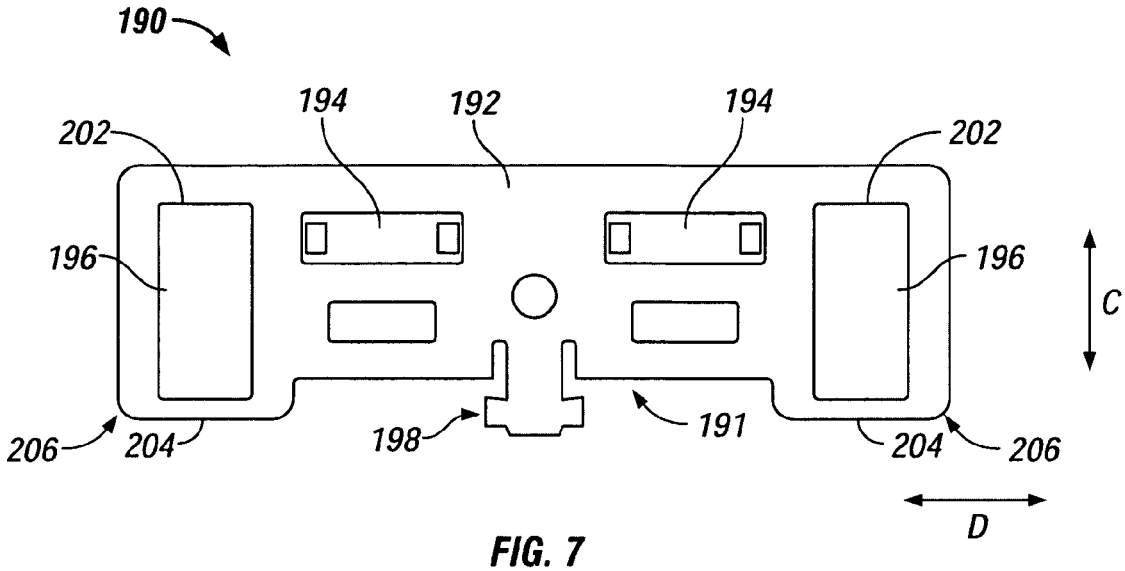
FIG. 7 is a top plan view of a solder clip formed in accordance with an exemplary embodiment of the present invention.

FIG. 7 is a top plan view of a solder clip 190 formed in accordance with an exemplary embodiment of the present invention. The clip 190 includes a main body section 192 having mounting apertures 194 and alignment apertures 196. The mounting apertures 194 are shaped and dimensioned for press fit insertion over the mounting lugs 120 of the housing 100 (shown in FIGS. 1 and 2), and the alignment apertures 196 are sized and dimensioned to receive the alignment lugs 124 (shown in FIGS. 1 and 2) of the housing 100. As such, the solder clip 190 may be aligned vertically in the direction of arrow C and horizontally in the direction of arrow D when the solder clips 190 are installed on the respective lateral walls 104 of the housing 100.

A retention tab 198 is formed on an edge 191 of the body section 192 which faces the contact interface 110 (shown in FIG. 2) of the housing 100 when the solder clip 190 is installed. The tab 198 may be folded over a lateral side wall 104 and retained in the notch 127 (shown in FIG. 2) therein. Edges 202 of the alignment apertures 196 contact the biasing ribs 126 (shown in FIG. 1) of the alignment lugs 124 of the housing 100. Assurance is therefore provided against movement of the solder clip 190 along two mutually perpendicular axes indicated by arrows C and D.

In an exemplary embodiment, the solder clip 190 is fabricated from a sheet of metal according to a stamping and forming operation. It is recognized, however, that the solder clip 190 may be fabricated from a variety of materials according to various known processes in the art in alternative embodiments.

While in an exemplary embodiment the retention tab 198 is formed in the shape of a T, it is understood that various shapes may be used in lieu of a T shape in alternative embodiments to retain the solder clip 190 to a side wall 104 of the housing 100.

Alignment tabs 204 project from the edge 191 and include solder clip board engagement surfaces 206 which are flat and smooth. The board engagement surfaces 206 contact a planar surface of a circuit board during surface mounting of the header assembly and are soldered to the circuit board. The soldering of the alignment tabs 204 provides structural strength and rigidity which provides strain relief to the soldered connections of the contact sets 150 and 170.

Figure 8:
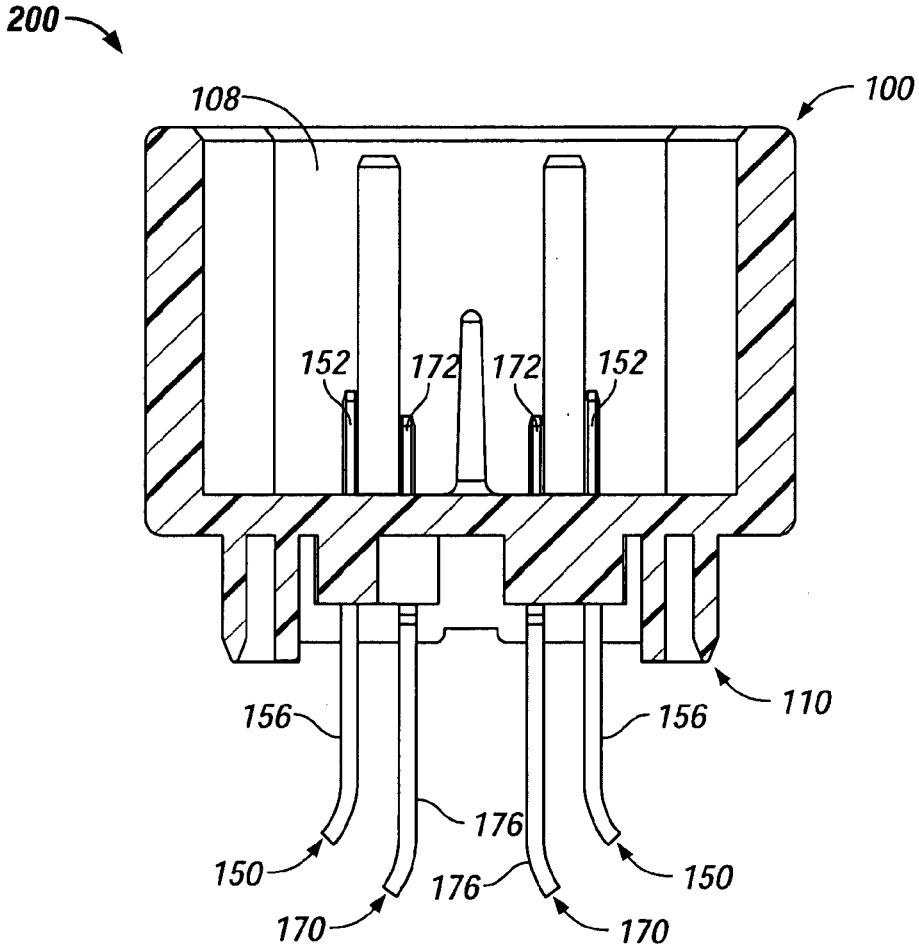
FIG. 8 is a cross sectional view of a header assembly formed in accordance with the present invention at a first stage of manufacture.

FIG. 8 is a cross sectional view of a header assembly 200 at a first stage of manufacture. The header assembly 200 includes the housing 100 with the contact sets 150 and 170 inserted into the outer and inner rows of contact apertures 112 and 114 (shown in FIGS. 1 and 2). The contact sections 152 and 172 of the respective contact sets 150 and 170 are partly located in the contact cavity 108 while the solder tail sections extend from the contact interface 110 of the housing 100.

Figure 9:
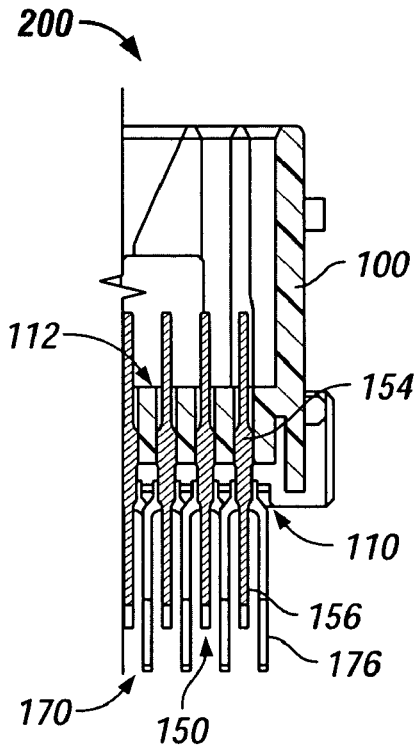
FIG. 9 is a partial cross sectional view of the header assembly shown in FIG. 8 along line 9—9 of FIG. 2.

FIG. 9 is a partial cross sectional view of the header assembly 200 through the outer row of contact apertures 112. The aperture sections 154 of the contact set 150 extend partially into the contact apertures of the row 112 for a predetermined distance, and the aperture sections 154 of the contact set 150 partly extend from the contact interface 110 of the housing 100. The carrier strips 158 (shown in FIG. 3) have been sheared from the contact set 150, thereby forming discrete contacts in the apertures in the contact aperture row 112. The solder tail sections 156 of the contact set 150 are located between the solder tail sections 176 of the contact set 170, and the centerlines of the solder tail sections 176 and 156 are consistently spaced from one another.

Figure 10:
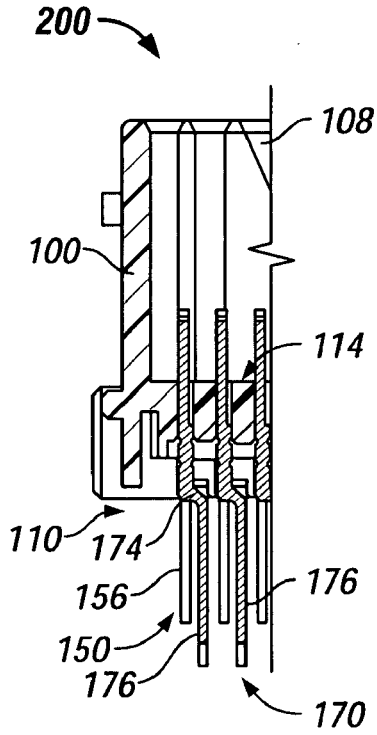
FIG. 10 is a partial cross sectional view of the header assembly shown in FIG. 8 along line 10—10 of FIG. 2.

FIG. 10 is a cross sectional view of the header assembly 200 through the inner row of contact apertures 114. The aperture sections 174 of the contact set 170 extend partially into the contact apertures of the row 114 for a predetermined distance, and the aperture sections 174 of the contact set 170 partly extend from the contact interface 110 of the housing 100. The carrier strips 178 (shown in FIG. 5) have been sheared from the contact set 170, thereby forming discrete contacts in the apertures in the contact aperture row 114. The solder tail sections 176 of the contact set 170 are located between the solder tail sections 156 of the contact set 150, and the centerlines of the solder tail sections 176 and 156 are consistently spaced from one another.

Figure 11:
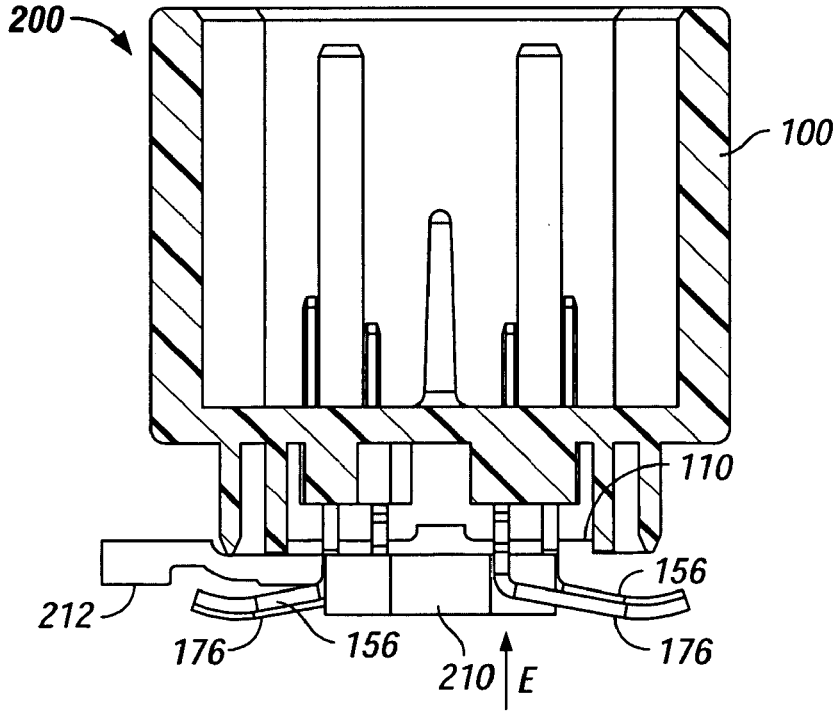
FIG. 11 is a cross sectional view of the header assembly at a second stage of manufacture.

FIG. 11 is a cross sectional view of the header assembly 200 at a second stage of manufacture wherein tooling, such as forming dies 210 and 212, is employed to bend the solder tail sections 156 and 176 toward the contact interface 110 of the housing 100. Once the forming die 212 is removed, the contacts may be further inserted through the contact interface 110 by seating the forming die 210 in the direction of arrow E to bring the bent solder tail sections 156 and 176 to the contact interface 110.

While the embodiment described thus far includes bending of the contact sets 150, 170 after they are partially installed in the housing 100, it is recognized that the contact sets 150, 170 could be bent prior to installation to the housing 100 in an alternative embodiment.

Figure 12:
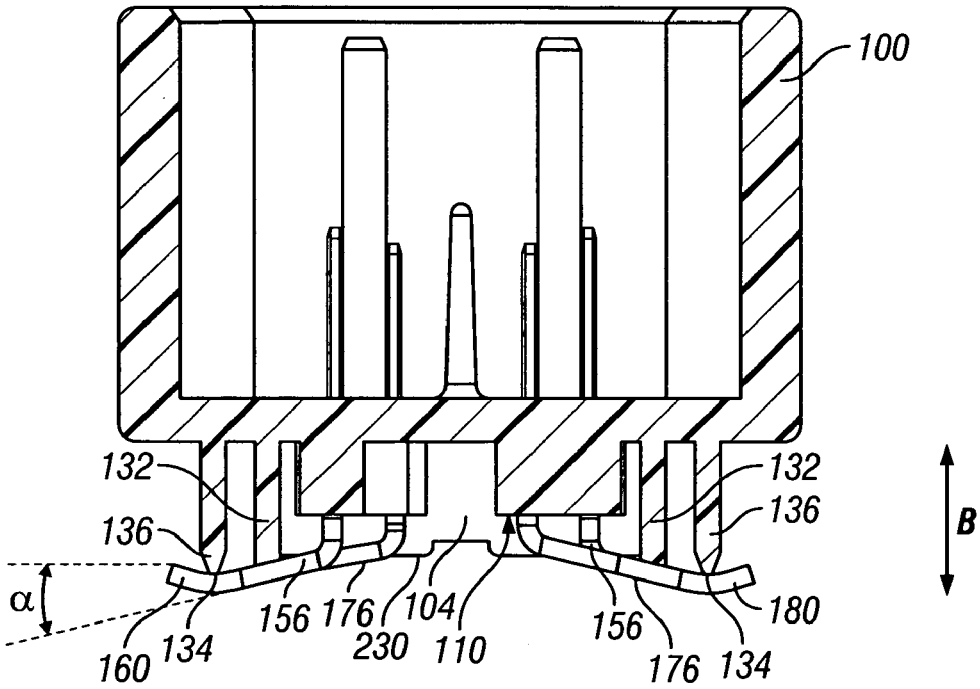
FIG. 12 is a cross sectional view of the header assembly at a third stage of manufacture.

FIG. 12 is a cross sectional view of the header assembly 200 at a third stage of manufacture wherein the aperture sections 154 and 174 (shown in FIGS. 9 and 10) are fully inserted into the respective rows of contact apertures 112 and 114 in the housing 100 to a final position. In the final position, the solder tail sections 156 and 176 are fitted through the slots in the positioning member 132 (also shown in FIG. 2), and the rounded ends 160 and 180 of the respective solder tail sections 156 and 176 are aligned with one another and in abutting contact to the alignment rib 136. As shown in FIG. 12, the alignment surface 134 is rounded or crowned and shaped to smoothly establish contact with the rounded end 160 and 180 of the contact sets 150 and 170. The solder tail sections 156 and 176 are flexed from the position shown in FIG. 11 and are obliquely oriented to the contact interface 110 of the housing 100, thereby creating in internal biasing force in the contact sets 150 and 170 which preloads the solder tail sections 156 and 176 against the alignment surfaces 134 of the alignment ribs 136. Such biasing or preloading of the solder tail sections 156 and 176 substantially prevents vertical movement of the solder tail sections 156 and 176 in the direction of arrow B as the header assembly 200 is handled prior to surface mounting and during surface mounting installation. Further, a final angle a of the solder tails 156 and 176 with respect to a top surface 230 of the lateral side walls 104 assures a satisfactory solder joint to a circuit board.

The crowned alignment surfaces 134 of the alignment ribs 136 and the rounded ends 160 and 180 of the solder tail sections 156 and 176 permits some misalignment of the solder tail sections 156 and 176 as the contact sets 150 and 170 are installed. The rounded engagement surfaces of the alignment surfaces 134 and the ends 160 and 180 of the contact sets 150 and 170 allow for shifting points of contact among the engagement surfaces as the contact sets 150 and 170 are moved to the final position. As the solder tail sections 156 and 176 are preloaded against the alignment ribs 136, relative misalignment of the solder tails is substantially, if not entirely, eliminated and the rounded ends 160 and 180 of the contact sets 150 and 170 are substantially aligned to produce coplanar contact points tangential to the rounded ends for mounting to a circuit board.

While in the illustrated embodiment the alignment surfaces 134 are crowned and the ends 160 and 180 of the contact sets 150 and 170 are rounded, it is appreciated that in an alternative embodiment the alignment surface may be substantially flat and the contact ends may be substantially straight while nonetheless aligning the contacts in a planar relationship to one another for surface mounting to a circuit board.

Figure 13:
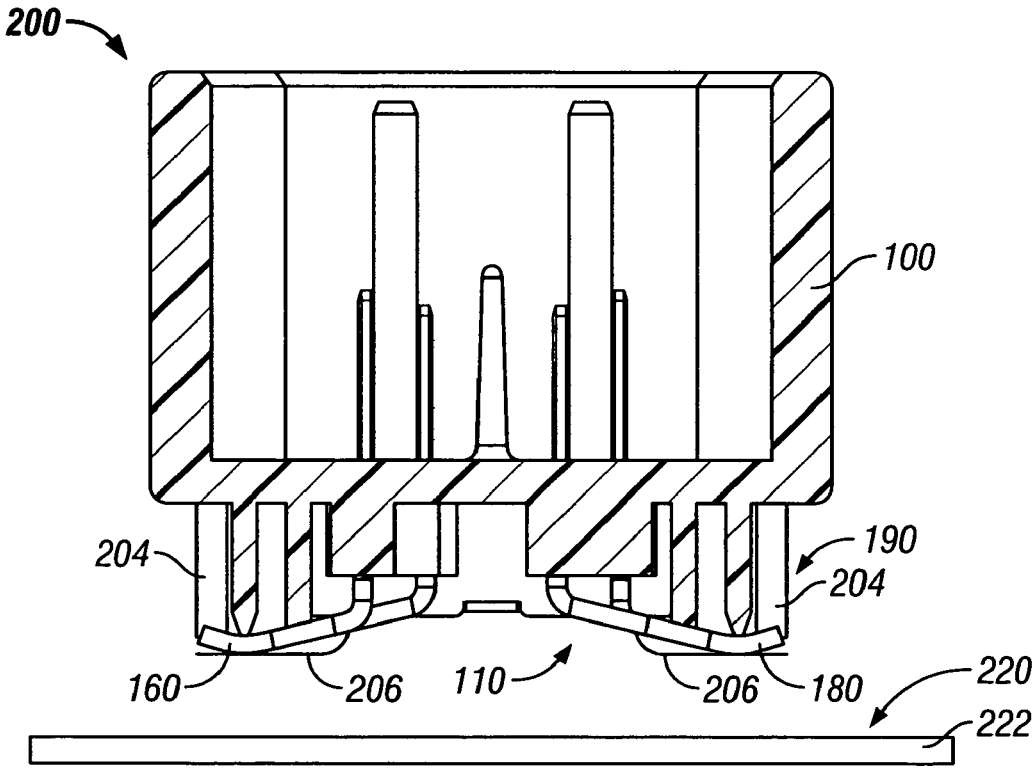
FIG. 13 is a cross sectional view of the header assembly at a final stage of manufacture.

FIG. 13 is a cross sectional view of the header assembly 200 at a final stage of manufacture wherein the solder clips 190 are attached to the housing 100. The engagement surfaces 206 of the solder clip alignment tabs 204 are coplanar with the contact ends 160, 180 of the contacts sets 150 and 170. The contact interface 110 is therefore well suited for surface mounting to a planar surface 220 of a circuit board 222.

Figure 14:
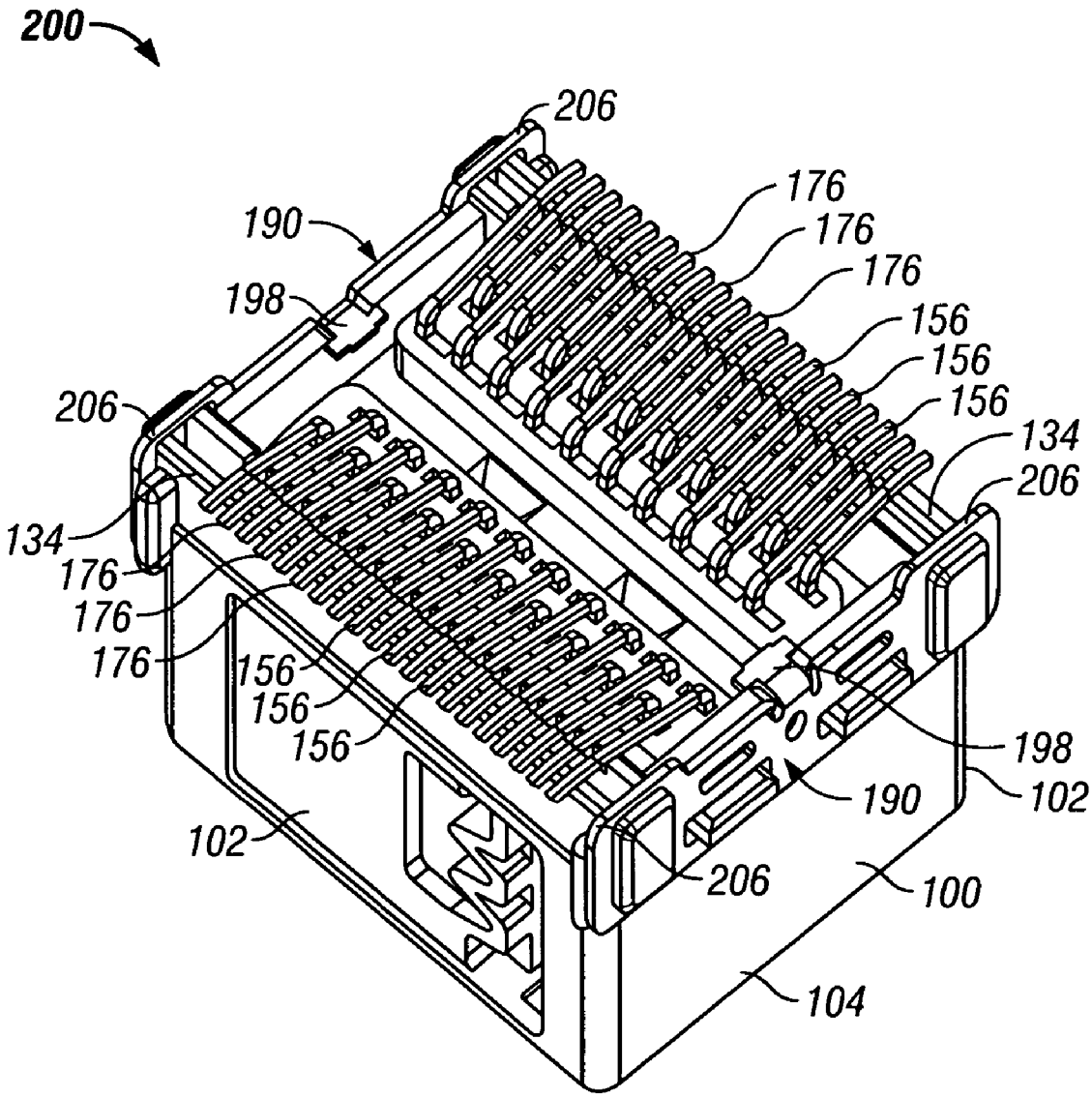
FIG. 14 is a bottom perspective view of the header assembly shown in FIG. 13.

FIG. 14 is a bottom perspective view of the header assembly 200 when completely assembled. The solder clips 190 are coupled to the lateral side walls 104 of the housing 100 and retained thereto by the retention tabs 198. The solder tail sections 156 and 176 are preloaded and abutted against the alignment surfaces 134 adjacent the longitudinal side walls of the housing 100. Manufacturing tolerances in fabricating the contact sets 150 and 170 are mitigated and the solder tail sections 156 and 176 are substantially aligned and coplanar for mounting to the planar surface 220 of the board 222 (shown in FIG. 13). The solder clip board alignment surfaces 206 are substantially aligned and coplanar with the solder tail sections 156 and 176 for secure mounting to the circuit board 222 in the plane of the solder tail sections 156 and 176. Relatively thin and consistent films of solder paste may therefore be used for reliably soldering the header assembly 200 to the circuit board 222.

For all the above reasons, a secure and reliable header assembly is provided for surface mounting applications which capably resists high insertion and extraction forces when the header assembly 200 is engaged and disengaged from a mating connector.

While the invention has been described in terms of various specific embodiments, those skilled in the art will recognize that the invention can be practiced with modification within the spirit and scope of the claims.

What is claimed is:

1. A header assembly comprising:

an insulative housing comprising a plurality of walls defining an interior cavity, wherein said insulating housing comprises at least one alignment rib extending on an exterior surface thereof; and a plurality of contacts within said cavity and extending through one of said walls to an exterior of said housing for surface mounting to a circuit board, each of said contacts having a rib engagement area and a board contact point for surface mounting to the circuit board, wherein said contacts engage said alignment rib at said engagement areas such that said alignment rib is aligned with said board contact points of said contacts and said contacts are flexed by said alignment rib to create an internal biasing force in said contacts to ensure coplanarity of said contacts for surface mounting to the circuit board.

2. A header assembly in accordance with claim 1 wherein said housing comprises longitudinal side walls and lateral side walls, said alignment rib extending parallel to one of said longitudinal and lateral side walls.

3. A header assembly in accordance with claim 1 wherein said housing comprises longitudinal side walls and lateral side walls and a pair of alignment ribs, said alignment ribs extending parallel to a respective one of said longitudinal and lateral side walls.

4. A header assembly in accordance with claim 1 wherein said housing comprises longitudinal side walls and lateral side walls, said alignment rib extending parallel to each of said longitudinal side walls.

5. A header assembly in accordance with claim 1 wherein said housing comprises longitudinal side walls, lateral side walls, and a bottom wall, said contacts extending through said bottom wall in a plurality of rows, said contacts in each of said plurality of rows abutting said alignment rib.

6. A header assembly in accordance with claim 1 wherein said contacts are oriented substantially parallel to the exterior surface of said insulative housing having said alignment rib when said contacts are in the preloaded position and said contacts are obliquely oriented with respect to the exterior surface of said insulative housing having said alignment rib when said contacts are in the loaded position.

7. A header assembly in accordance with claim 1 wherein said contacts comprise a length, some of said contacts having a first length and some of said contacts having a second length, said first length greater than said second length, wherein each of said first length and said second length extends to said alignment rib.

8. A header assembly in accordance with claim 1 wherein said contacts comprises staggered contacts of different lengths, each of said staggered contacts engaging said alignment rib.

9. A header assembly in accordance with claim 1 further comprising a solder clip attached to one of said longitudinal and said lateral side walls, said solder clip comprising an engagement surface coplanar with said contacts when said contacts are abutted against said alignment rib.

10. A header assembly in accordance with claim 1 wherein said contacts include rounded ends and said alignment rib comprises a crowned surface, said rounded ends engaging said crowned surface as said contacts are preloaded.

11. A header assembly comprising:

an insulative housing comprising a plurality of walls defining an interior cavity and a contact interface, and at least one alignment rib extending proximate said contact interface; and a plurality of contacts having contact sections and solder tail sections, said contact sections located within said interior cavity, said solder tail sections extending exterior to said contact interface for surface mounting to a circuit board at board contact points of said contacts, wherein said solder tails abut said alignment rib and are flexed by said alignment rib as said contacts are installed into said housing, thereby creating an internal biasing force in said contacts to ensure coplanarity of said solder tail sections for surface mounting to the circuit board, when said contacts are installed into said housing, said solder tails are positioned between said alignment rib and the circuit board such that said alignment rib is aligned with said board contact points of said contacts.

12. A header assembly in accordance with claim 11 wherein said contact sections extend substantially perpendicular to a bottom wall of said housing, and said solder tail sections extend obliquely to said bottom wall of said housing.

13. A header assembly in accordance with claim 11 wherein said solder tail sections are flexed about said alignment rib.

14. A header assembly in accordance with claim 11 wherein said housing comprises longitudinal side walls and lateral side walls, said alignment rib extending parallel to one of said longitudinal and lateral side walls.

15. A header assembly in accordance with claim 11 wherein said alignment rib comprises a crowned surface, said solder tail sections abutting said crowned surface.

16. A method of assembling a surface mount header assembly, the assembly including an insulative housing including a plurality of walls defining an interior surface, an exterior surface and a plurality of contact apertures extending therebetween, the housing further including an alignment rib extending on the exterior surface, the assembly further including a plurality of electrical contacts, the method comprising:

inserting the contacts through the contact apertures;

flexing a portion of the contacts against the alignment rib as the contacts are inserted, thereby preloading the contacts against the alignment rib in a coplanar relationship with one another for surface mounting to a circuit board; and orienting the alignment rib with a mounting surface of the circuit board such that the contacts are positioned between the alignment rib and the mounting surface and the alignment rib is aligned with board contact points of the contacts.

17. A method in accordance with claim 16 further comprising partially inserting the contacts through the housing to a first position;

bending the contacts relative to the exterior surface such that an end of each contacts is angled relative to the exterior surface, the angle of the bent contacts substantially equal among the contacts, the angled ends of the contacts separated from the alignment rib; and further inserting the contacts through the contact apertures to a second position wherein the ends of the contacts are in an abutting relationship with the alignment rib.

18. A method in accordance with claim 16 wherein said inserting the contacts comprises inserting the contacts in multiple rows such that the contacts are staggered relative to one another.

19. A method in accordance with claim 16 wherein the housing includes a pair of alignment ribs on opposite sides of the housing, said further inserting the contacts to a second position comprising positioning some of the contacts in abutting relationship to one of the alignment ribs and positioning other of the contacts in abutting relationship to the other alignment rib.

20. A header assembly comprising:

an insulative housing having a mounting face and comprising an alignment rib extending along the mounting face and having a planar alignment edge along the mounting face; and a plurality of contacts positioned relative to said housing, such that a mounting portion of each of said contacts is positioned between the alignment rib and a circuit board, and such that a mounting portion of each of said contacts abuts and is flexed by said alignment edge during a loading process of said contacts to create an internal biasing force in said mounting portion thereby ensuring coplanarity of said contacts along the mounting face.

21. The header assembly of claim 20 further comprising at least one solder clip attached to said housing, said at least one solder clip having a planar mounting edge parallel to said alignment edge and spaced from said alignment edge a distance generally equal to a thickness of each of said plurality of contacts.

* * * * *